US007793917B1

(12) United States Patent
Schmidt, II

(10) Patent No.: US 7,793,917 B1
(45) Date of Patent: Sep. 14, 2010

(54) CEILING CUP TERMINATION SYSTEM

(75) Inventor: James J Schmidt, II, Boling Brook, IL (US)

(73) Assignee: Metropolitan Air Technology, Bedford Park, IL (US)

( * ) Notice: Subject to any disclaimer, the term of this patent is extended or adjusted under 35 U.S.C. 154(b) by 1148 days.

(21) Appl. No.: 11/420,058

(22) Filed: May 24, 2006

(51) Int. Cl.
*F16K 31/00* (2006.01)

(52) U.S. Cl. ..... 251/294

(58) Field of Classification Search ..... 251/294; 74/501.6, 500.5, 502.6; 454/333, 361, 358; 4/412

See application file for complete search history.

(56) References Cited

U.S. PATENT DOCUMENTS

| | | | | | |
|---|---|---|---|---|---|
| 1,529,900 | A | * | 3/1925 | Mayer | 251/294 |
| 2,652,245 | A | | 9/1953 | Bentley | |
| 3,197,549 | A | | 7/1965 | Good | |
| 3,738,572 | A | | 6/1973 | Hall | |
| 4,295,486 | A | * | 10/1981 | McCabe | 137/80 |
| 4,534,088 | A | | 8/1985 | Ricke | |
| 4,717,121 | A | | 1/1988 | Hashimoto | |
| 4,823,978 | A | * | 4/1989 | Pufpaff | 220/787 |
| 4,903,541 | A | * | 2/1990 | Shiota | 74/501.5 R |
| 5,354,234 | A | | 10/1994 | Arold | |
| 5,461,938 | A | * | 10/1995 | Froling et al. | 74/502.4 |
| 5,588,911 | A | * | 12/1996 | Gomez | 454/290 |
| 5,702,298 | A | * | 12/1997 | Conkling | 454/322 |
| 5,921,277 | A | | 7/1999 | Bernal | |
| 6,005,190 | A | * | 12/1999 | Stark et al. | 174/66 |
| 6,142,867 | A | | 11/2000 | Lee | |
| D438,175 | S | * | 2/2001 | Stark et al. | D13/152 |
| 6,354,934 | B1 | | 3/2002 | Seuge | |
| 6,561,895 | B2 | * | 5/2003 | McGill | 454/298 |
| 6,682,257 | B1 | | 1/2004 | Zappe | |
| 6,740,813 | B1 | * | 5/2004 | Gretz | 174/66 |
| 7,178,430 | B2 | * | 2/2007 | Butz | 81/124.2 |
| 2004/0058639 | A1 | | 3/2004 | Perrin | |
| 2008/0251652 | A1 | * | 10/2008 | Hollender et al. | 248/65 |

* cited by examiner

*Primary Examiner*—John Rivell
*Assistant Examiner*—Marina Tietjen
(74) *Attorney, Agent, or Firm*—Adam K Sacharoff; Much Shelist

(57) ABSTRACT

A termination system for a cable integrated to control a damper, wherein an end portion of the cable is provided about an opening formed in a ceiling or wall, the system includes: a suspension mount having a base and an opened region, the base has an aperture to receive the cable a retaining bar is secured to the suspension mount such that the ceiling or wall is positioned between the suspension mount and the retaining bar and such that the opened region of the suspension mount is positioned over the opening formed in the ceiling or wall, the retaining bar further including a central opening; and a cap having an inside portion and a peg extending from the inside portion, the cap further having an outer periphery sized larger than the retaining bar and larger than the opening formed in the ceiling or wall, and the central opening of the retaining bar is sized to engage the peg, wherein engagement of the peg with the central opening enables the cap to obscure from visibility the retaining bar, the opening in the ceiling or wall, and the cable, and wherein the cap is able to be removed from the retaining bar to provide access to the cable for controlling said damper.

4 Claims, 3 Drawing Sheets

CEILING CUP TERMINATION SYSTEM

FIELD OF THE INVENTION

The present invention relates to a ceiling cup termination system for an integrated cable controller for an air balancing damper system.

BACKGROUND OF THE INVENTION

The prior art teaches air dampening system which utilize an integrated cable to control the opening and closing of one or more blade dampers in an air duct. U.S. Pat. No. 5,921,277 illustrates a good example of an air duct provided with a single paddle or blade that is positioned within the air duct and is manually adjusted by manipulating an integrated cable. The end of the cable terminates at a knob which is then turned to rotate and move the paddle. U.S. Pat. No. 3,738,572 provides for another type of air flow control system which also uses a knob to control the damping system. In these examples and other similar prior art devices, the integrated cable terminates at an end that is either exposed within or accessible to the environment. In most circumstances a knob is provided that is easily turned, by anyone, to adjust the blade dampers. However, in certain circumstances, access needs to be limited, such as in office buildings. In limited access situations, the integrated cable may terminate at the office room's ceiling. An end cap, well known in the industry, is provided to cover the terminating end of the integrated cable. To gain access, the end cap is removed. However, the end caps typically do not lie flush with the ceiling, are obtrusive, and even non-aesthetic to the architectural demands of a building.

In one embodiment of the present invention there is provided a ceiling cup termination system for an integrated cable controlled air balancing damper system as described and provided for herein below.

SUMMARY OF THE INVENTION

A termination system for a cable integrated to control a damper is provided, wherein an end portion of the cable is provided about an opening formed in a ceiling or wall, the system includes: a suspension mount having a base and an opened region, the base has an aperture to receive the cable; a retaining bar is secured to the suspension mount such that the ceiling or wall is positioned between the suspension mount and the retaining bar and such that the opened region of the suspension mount is positioned over the opening formed in the ceiling or wall, the retaining bar further including a central opening; and a cap having an inside portion and a peg extending from the inside portion, the cap further having an outer periphery sized larger than the retaining bar and larger than the opening formed in the ceiling or wall, and the central opening of the retaining bar is sized to engage the peg, wherein engagement of the peg with the central opening enables the cap to obscure from visibility the retaining bar, the opening in the ceiling or wall, and the cable, and wherein the cap is able to be removed from the retaining bar to provide access to the cable for controlling the damper.

The termination system may also include a grommet positioned about the opening in the base of the suspension mount and having an central opening to accommodate the cable. This would allow the cable to turn and slide in the opening and may even reduce damage to the cable as it would not come into contact with the edges of the opening.

The termination system may also include a ferrule secured to a portion of the cable that is within the opened region of the suspension mount. The ferrule has a larger diameter then the opening, thereby preventing the cable from being pulled or pushed out of the opened region of the suspension mount.

The termination system may also include a side mounting bracket that permits the suspension mount to be secured to a side structure such as a beam or truss. The side mounting bracket includes a base portion having a center aperture to receive the cable such that the side mounting bracket is secured to the termination system and a side portion positioned at an angle from the base portion that permits the mounting to the side structure.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
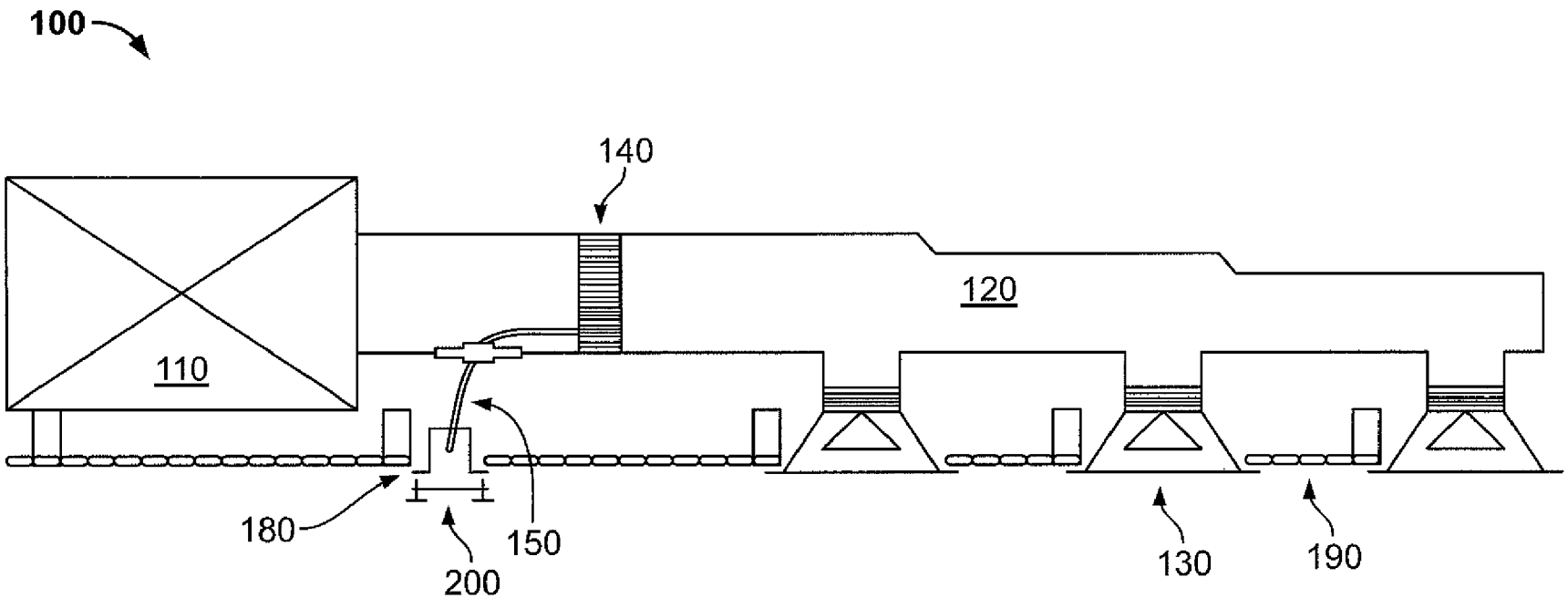
FIG. 1 is a system diagram of a ventilation system that includes a damper and a cable integrated thereto for remote control of the damper.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, there is shown an air, heat or ventilation system 100 that includes a main duct region 110 that leads to branch ducts 120 that include one or more ceiling dampers 130. The system 100 includes air balancing damper system 140 that separates the branch ducts 120 from the ma in duct region 110. The damper system 140 is controlled by an integrated cable 150. The integrated cable 150 terminates about a ceiling cup termination system 200 formed in a region 180 of the ceiling 190.

Figure 2:
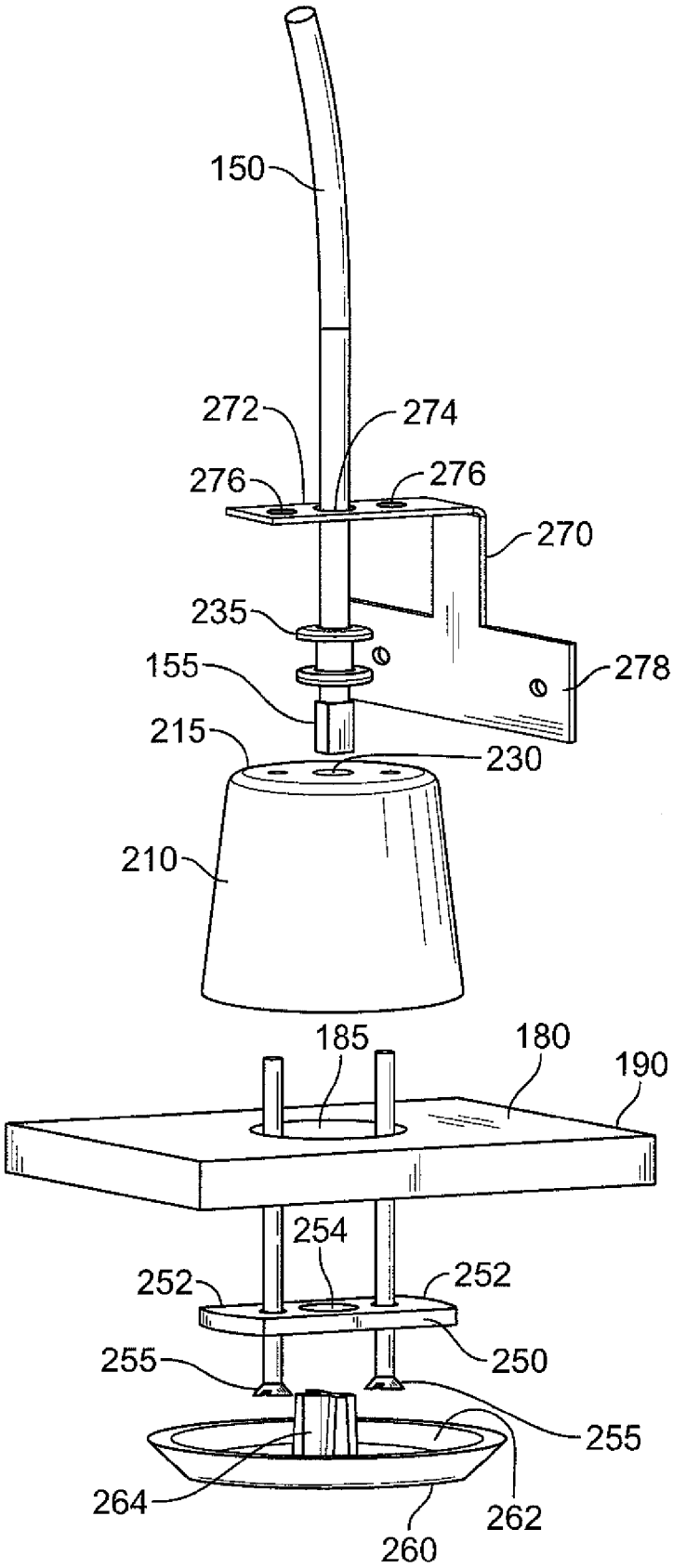
FIG. 2 is an exploded view of a termination system used to position an end portion of the cable near an opening in a ceiling or wall.
Figure 3:
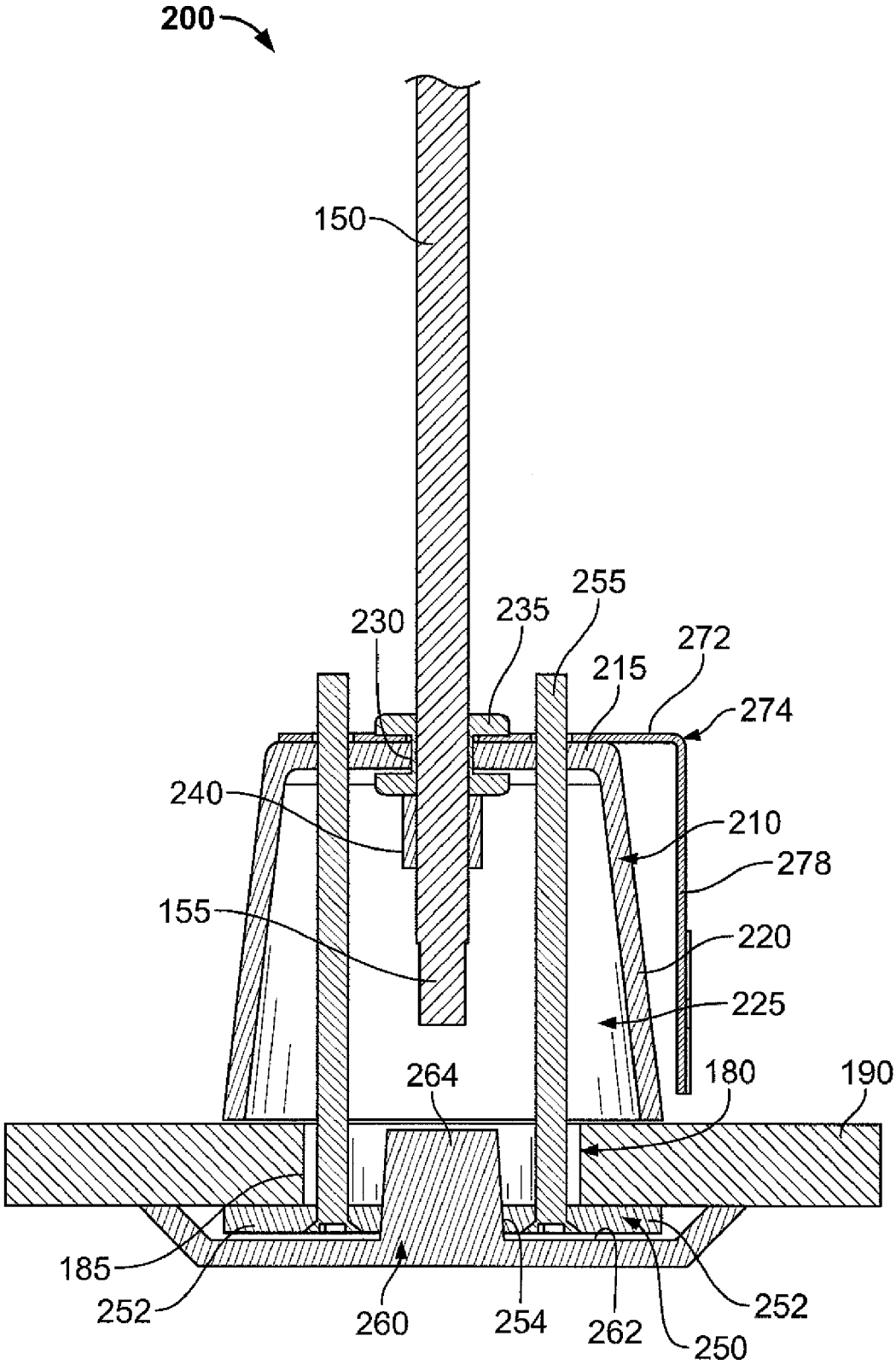
FIG. 3 is a cross sectional view of the termination system of FIG. 2.

A ceiling cup termination system 200 in accordance to an embodiment of the present invention is illustrated in FIGS. 2 and 3. The termination system 200 as mentioned above accommodates for an end portion 155 of the integrated cable 150, providing easy access to the end portion 155 such that the damper system 140 may be controlled.

Referring now to FIGS. 2 and 3, the termination system 200 is positioned about an opening 185 or hole in region 180 of the ceiling 190 or wall. The opening or hole is cut through the ceiling specifically for providing the access to the end portion 155 of the integrated cable 150. The termination system 200 however, keeps the end portion 155 of the integrated cable 150 sufficiently close to the opening 185 and also covers the opening 185 such that the opening 185 is not noticeable when covered and not being used.

The termination system 200 includes a suspension mount 210. The suspension mount 210 suspends the end portion 155 of the integrated cable 150 about the opening 185 in the ceiling. The suspension mount 210 in the figures is illustrated as a cup; however the basic shape is not important. The suspension mount 210 includes a base 215 and a wall 220, which ends to form an opened region 225 therebetween. The base 215 includes an aperture 230 sled to receive the cable 150. A grommet 235 may also be provided in the aperture. The grommet 235 may prevent the cable 150 from becoming damaged when pulled or turned in the aperture 230. The end portion 155 of the integrated cable 150 is positioned within the opened region 225 of the suspension mount 210. A ferrule 240 may be secured to a portion of the cable 150 on the opened region 225 side of the suspension mount 210. The ferrule 240 may prevent the cable 150 from being accidentally pushed all the way through the base 215 of the suspension mount 210.

The opened region 225 of the suspension mount 210 is positioned above the opening 185 in the ceiling 190. To maintain this position the suspension mount 210 is secured in place by a retaining bar 250 and a pair of screws 255. The retaining bar 250 is positioned on one side of the ceiling 190 over the opening 185 therein while the suspension mount 210 is positioned on the opposite side of the ceiling 190, thus the ceiling 190 is sandwiched between the retaining bar 250 and the suspension mount 210. The length of the retaining bar 250 is such that the ends 252 of the retaining bar 250 extend are over the opening 185 in the ceiling such that the ends 252 contact and press directly against a portion of the ceiling. The retaining bar 250 and the base 215 of the suspension mount 210 include corresponding openings to accommodate the pair of screws 255. Other means to secure the suspension mount 210 to the retaining bar 250 may be used in place of the pair of screws 255.

To conceal the retaining bar and the opening 185 in the ceiling 190, the termination system 200 includes a ceiling cover or cap 260. The cap includes an outer periphery that is sized larger than the retaining bar and the opening formed in the ceiling or wall. A means is provided for removably engaging the cap 260 to the retaining bar 250.

The means to removably engage the cap 260 to the retaining bar 250 is defined in one embodiment by providing the ceiling cap 260 with an inside portion 262 that faces the opening 185 in the ceiling 190. A central peg 264 extends from the inside portion 262 of the cap 260 towards the opening 185 in the ceiling 190. The peg 264 is captured and secured to a central aperture 255 in the retaining bar 250. The manner in which the peg 264 is secured to the retaining bar 250 may include threading the peg 264 to the retaining bar 250 or a tight frictional engagement. In either manner the cap 260 lies against the ceiling 190. Once the cap 260 is in place, the retaining bar 250 and the opening in the ceiling or wall is obscured from visibility.

To access the cable 150, the cap 260 is removed (either by reverse screwing or pulling the cap 260 off of the retaining bar 250. Access may then be obtained by directly accessing the end portion 155 of the cable 150. The end portion 155 of the cable is then turned or twisted which will control the damper system 140.

As described the termination system 200 is self supporting in the ceiling. However, the termination system 200 may also be affixed to a side structural member. To mount the termination system 200 to a side structural member a mounting bracket 270 is provided. The mounting bracket 270 includes a base portion 272 having a center aperture 274 to accommodate the cable 150 and a pair of opening 276 corresponding to the pair of screws 255. A side portion 278 that is positioned at an angle from the base portion 272, includes a pair of openings such that the side portion and thus the mounting bracket 270 may be affixed to a side structural member (not shown).

The color and material used to manufacture the cap 260 may be such that is matches identically or substantially identical to the existing ceiling, such that the termination system 200 is aesthetically pleasing and matches the decorum and/or architectural demands such that it is unobtrusive in the ceiling. The termination system 200 may also be mounted such that it is in a wail portion and is thus not simply limited to a ceiling mount. The suspension mount 210 is also preferably manufactured to have an area less than 2 square-inches such that it is in compliance with U.S. national fire codes regarding fire rate ceilings. However, the depth is not a limitation on the scope of the invention.

From the foregoing and as mentioned above, it will be observed that numerous variations and modifications may be made without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A termination system for a cable integrated to control a damper, wherein an end portion of said cable is provided about an opening formed in a ceiling or wall, the system comprising:

a suspension cup having a base and a side annular member extending from the base to define an opened region therebetween, the side annular member terminating at an edge with a perimeter larger than the opening formed in the ceiling or wall such that the edge of the side annular member is positioned directly against one side of the ceiling or wall, said base has an aperture to receive said cable such that the end portion of said cable is retained within the side annular member, the base further haying a pair of base openings separately positioned on either side of the aperture;

a retaining bar positioned directly against another side of the ceiling or wall opposite to the side of the ceiling or wall in which the edge of the side annular member is positioned, the retaining bar haying ends extending therefrom, the retaining bar secured to the suspension cup such that said ceiling or wall is positioned between said suspension cup and said retaining bar and such that said opened region of said suspension cup is positioned over said opening formed in said ceiling or wall, the retaining bar further including a central opening and a pair of retention openings separately positioned on either side of the central opening and corresponding for alignment with the pair of base openings;

a pair of fasteners separately securing through the pair of retention openings and the pair of base openings to secure the retaining bar to the suspension cup such that the ends of the retaining bar are directly pressed against a portion of the ceiling or wall; and a cap having an inside portion and a peg extending from said inside portion, said cap further having an outer periphery sized larger than said retaining bar and larger than said opening formed in said ceiling or wall, and said central opening of said retaining bar is sized to engage said peg, wherein engagement of said peg with said central opening enables said cap to obscure from visibility the retaining bar, the opening in the ceiling or wall, and said cable, and wherein said cap is able to be removed from said retaining bar to provide access to said cable for controlling said damper.

2. The termination system of claim 1 further comprising a grommet positioned about the opening in the base of the suspension cup and having an central opening to accommodate the cable.

3. The termination system of claim 2 further comprising a ferrule secured to a portion of the cable that is within the opened region of the suspension cup.

4. The termination system of claim 3 further comprising a side mounting bracket that includes: a base portion having a center aperture to receive the cable such that the side mounting bracket is secured to the termination system; and a side portion positioned at an angle from the base portion.

* * * * *